United States Patent [19]

Gunther, Jr.

[11] Patent Number: 4,694,632

[45] Date of Patent: Sep. 22, 1987

[54] MECHANISM FOR FOLDING AN ENVELOPE AROUND AN INSERT

[75] Inventor: William H. Gunther, Jr., Mystic, Conn.

[73] Assignee: Gunther International, Ltd., Mystic, Conn.

[21] Appl. No.: 899,645

[22] Filed: Aug. 25, 1986

Related U.S. Application Data

[63] Continuation-in-part of Ser. No. 747,704, Jun. 24, 1985, abandoned, which is a continuation of Ser. No. 423,665, Sep. 27, 1982, abandoned.

[51] Int. Cl.[4] ..... B65B 11/48

[52] U.S. Cl. ..... 53/55; 53/206; 53/209

[58] Field of Search ..... 53/206, 209, 534, 460, 53/55; 209/584, 900

[56] References Cited

U.S. PATENT DOCUMENTS

| | | | |
|---|---|---|---|
| 2,932,929 | 4/1960 | Fahrenzach | 53/534 X |
| 3,051,309 | 8/1962 | Leathers | 209/900 X |
| 3,059,391 | 10/1962 | Volks | 53/206 |
| 3,511,368 | 5/1970 | Kajitani | 209/900 |
| 3,601,952 | 8/1971 | Cato | 53/534 X |
| 3,673,763 | 7/1972 | Dorfman | 53/209 X |
| 4,071,997 | 2/1978 | Gunther, Jr. | 53/206 X |
| 4,299,073 | 11/1981 | Golicz | 53/206 X |
| 4,343,129 | 8/1982 | Gunther, Jr. | 53/206 |
| 4,464,878 | 8/1984 | Golicz | 53/206 |

*Primary Examiner*—John Sipos

*Attorney, Agent, or Firm*—Stoll, Wilkie, Previto & Hoffman

[57] ABSTRACT

A mechanism for automatically feeding individual pre-cut sheets and stuffing a personalized letter or some other pre-cut insert into a personalized envelope. The mechanism has means to permit additional inserts to be automatically added to the envelope and to automatically seal the contents within the envelope. The mechanism will also combine pre-cut inserts and envelopes fed from different sources and form them into a completed mailing envelope.

6 Claims, 6 Drawing Figures

MECHANISM FOR FOLDING AN ENVELOPE AROUND AN INSERT

CROSS-REFERENCE

This application is a continuation-in-part of U.S. patent application Ser. No. 747,704 filed June 24, 1985, now abandoned, which, in turn, is a continuation of Ser. No. 423,665 filed Sept. 27, 1982 now abandoned. The application is also an improvement over U.S. Pat. Nos. 4,343,129; 4,312,109; and 4,071,997 and the disclosures in said patents are incorporated herein by reference.

DESCRIPTION

The present invention is directed to an improved mechanism for making and folding an envelope and, more paticularly, to a mechanism for folding an envelope around a letter or some other insert.

In various promotions, such as solicitations for subscribers, funds, etc., it is desirable for the envelope and the letter or other similar insert or message enclosed with the envelope to be personalized. Even if the personalized insert and envelope are both automatically printed by a computer, it is an expensive and a time-consuming operation to stuff the personalized letter or other insert into the corresponding personalized envelope and to seal it. In addition, it is sometimes desirable to add additional inserts to be sent with the letter.

There exists machinery to produce a letter from a continuous web that is personalized to an individual along with an envelope that is to be used for that same individual. The letter and envelope either follow one another or are adjacent to each other on a side-by-side relationship. That machine was designed to take into account that printers used continuous webs in conjunction with the computers of that time.

However, there now exists high speed laser computer printers which work from individual pre-cut sheets and not from continuous webs. Present machines do not provide for automatic feeding of pre-cut inserts and envelopes and for automatically adding additional inserts to the envelopes.

The present invention overcomes these difficulties and has for one of its objects the provision of an improved mechanism which will automatically feed individual pre-cut sheets and stuff a personalized letter or some other pre-cut insert, such as a return envelope or the like, into a personalized envelope, and which will permit additional inserts to be automatically added to the envelope and which will automatically seal the contents within the envelopes.

Another object of the present invention is the provision of an improved mechanism for combining pre-cut inserts and envelopes fed from different sources and form them into a completed mailing enclosure.

Other and further objects of the invention will be obvious upon an understanding of the illustrative embodiment about to be described, or will be indicated in the appended claims, and various advantages not referred to herein will occur to one skilled in the art upon employment of the invention in practice.

The machine of the present invention is capable of feeding from two stacks of sheets - one being a letter or other message to an individual and the other being a blank used for the envelope which has also been computerized and addressed to that same individual. The machine may include an optical reading recognition mechanism, either by Optical Mark Reading (OMR) or Bar Code Reading (BCR) or an Optical Character Recognition (OCR) where an individual's name or Arabic printed number is read, decoded and identified to coincide with the same name or number on a corresponding document.

In existing printing machines, the forms are printed and delivered upside down so that the first form is face down in the delivery mechanism. Thus, if the hopper hold one thousand sheets, sheet No. 1 would be on the bottom and sheet No. 1,000 would be on the top. When this stack of papers were processed, the next stack would have a sheet on the bottom with No. 1,001 and the last sheet on the top would be No. 2,000. Since existing folding or sealing machines must take sheets into its system face down, if such stacks were used as they were produced by the printing machine, the first stack would be processed with sheet No. 1,000 the first to be produced and sheet No. 1 the last to be produced. The next stack then would start with sheet No. 1,001 which would follow sheet No. 1 of the previous stack thereby making the entire system out of zip code sequence.

Although this could be overcome by completing a total run of 1,000,000 forms before the first letter would be run through pre-cut folding and sealing machines and then run them in reverse order, starting with 1,000,000 back to 1 so that they could then still stay in zip code order. The storage of the various stacks of paper would be inconvenient and could cause major problems in that the two machines could not be run simultaneously which is one of the requisites of the competitive business using direct mail production in order to get things done as they are being produced.

In addition, existing machines for forming envelopes around letters do not use a blank which forms a typical envelope with front and rear panels, side flaps and an end flap. In existing machines, the straight edges of the front and rear panels of an envelope blank are glued together and the end flap is then glued over the two panels. Hence, the envelope that the user receives does not look like a personalized envelope, but a machine-made envelope. It is believed that this causes some recipient of such envelopes to discard these envelopes without opening them thinking that they are solicitations.

Furthermore, in existing machines, the data on the envelope and the letter is read by a reading mechanism after the letter and envelopes are fed from the stacks. Hence, if the letter does not match with an envelope, the entire feeding and gluing cycle must be stopped until the matter is corrected.

The present invention overcomes these drawbacks and provides a machine having two bottom feeding devices or hoppers which would process pre-cut letters and envelopes exactly as they are produced from a printer and feed them from the bottom so that the hoppers can continue to be loaded from the top. As each sheet is fed out of the hopper or feeding device, it is read by a reading mechanism to verify that the letter insert did, in fact, match the name and address on the envelope. Additional information could be read from the letter part indicating that there would be more than one sheet to the letter.

There are also provided means as to whether additional feeders should be activated which would add single or multiple personalized or unpersonalized sheets during the movement of the original letter and envelope on the conveyor system. The original letter would also contain information whether or not additional inserts placed on the machine should or should not be activated to add advertising or other type documents to the package. Finally, the same reading mechanism also disseminates zip code sorting and weight sorting for each individual letter as it is being produced.

The machine is a two-level conveyor system capable of moving the envelope at one level and the letter insert at a higher level with feeders on opposite sides feeding the documents sideways into the conveyor so that they would move at a right angle directly into the machine. Space would be left for two or more additional feeders on each side of the conveyor in the event that the customer wished to have the ability to add additional sheets to the letter which are called for in many instances.

The same mechanism could also be used to feed from continuous form multiple pages being added where the other side would be run from either sheet produced envelopes or continuous form envelopes, but only one envelope to each customer. This ability is not available with the existing machines.

The present invention also provides a mechanism which will use an envelope blank having not only front and rear panels and an end panel, but also having side flaps which are folded inwardly and glued so that the finished envelope looks like a personalzied envelope and not like a machine-made envelope.

Furthermore, the present mechanism positions the reader so that the data on the letter and the envelope is scanned and read while the envelope and the letter are still in the stacks and before they are fed. Hence, should a particular envelope not match a particular letter, the matter can be corrected before they are fed to the conveyors and the feeding, folding and gluing of other envelopes and letters can continue without interruption.

A preferred embodiment of the invention has been chosen for purposes of illustration and description and is shown in the accompanying drawings forming a part of the specification, wherein.

Figure 1:
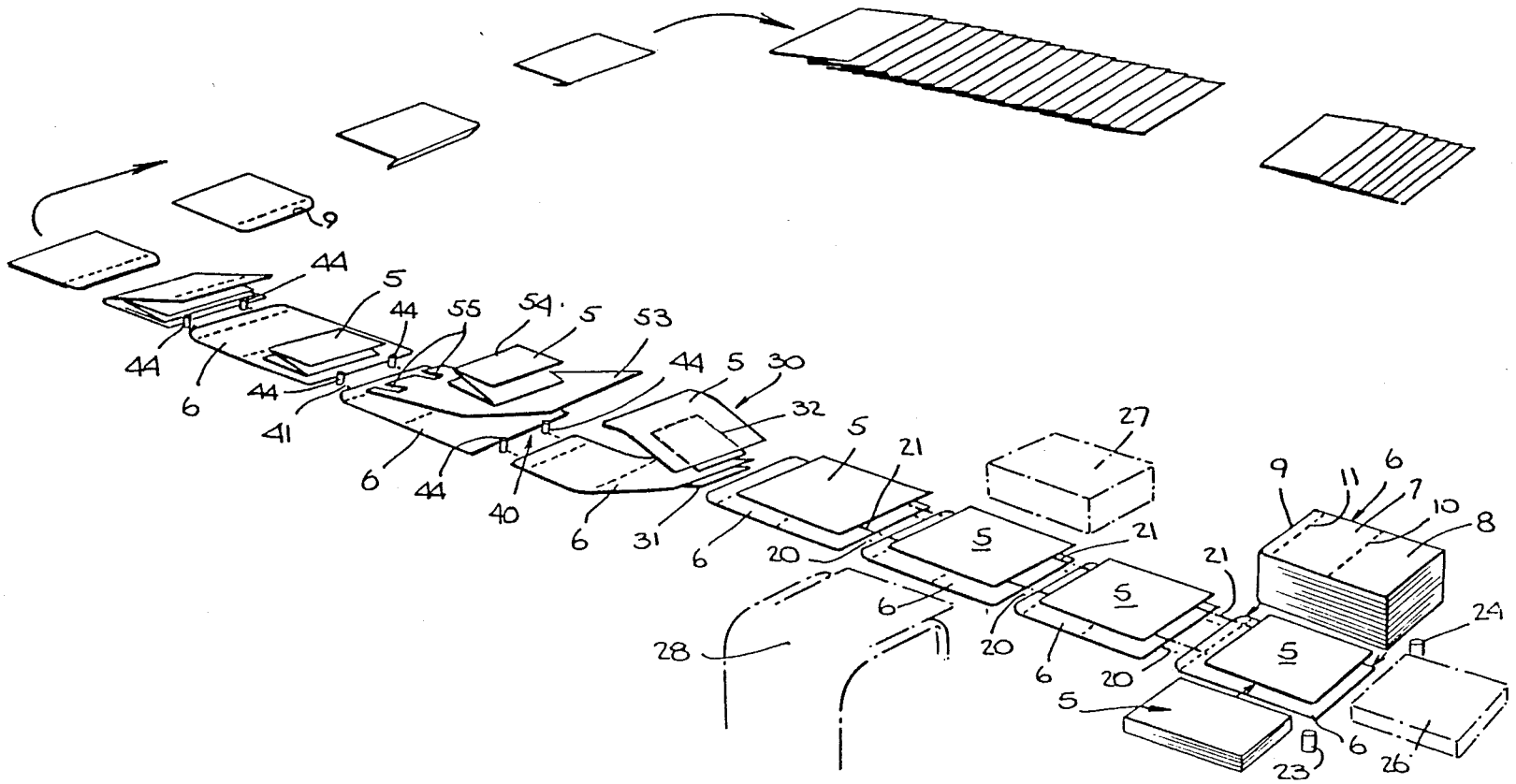
FIG. 1 is a schematic diagrammatic view of the present invention.
Figure 2:
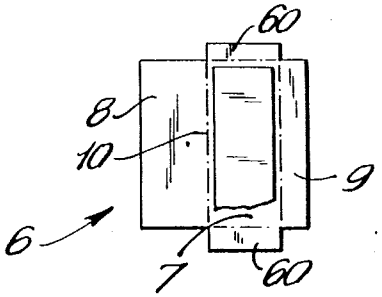
FIG. 2 is a top plan view showing an envelope with an insert thereon.
Figure 3:
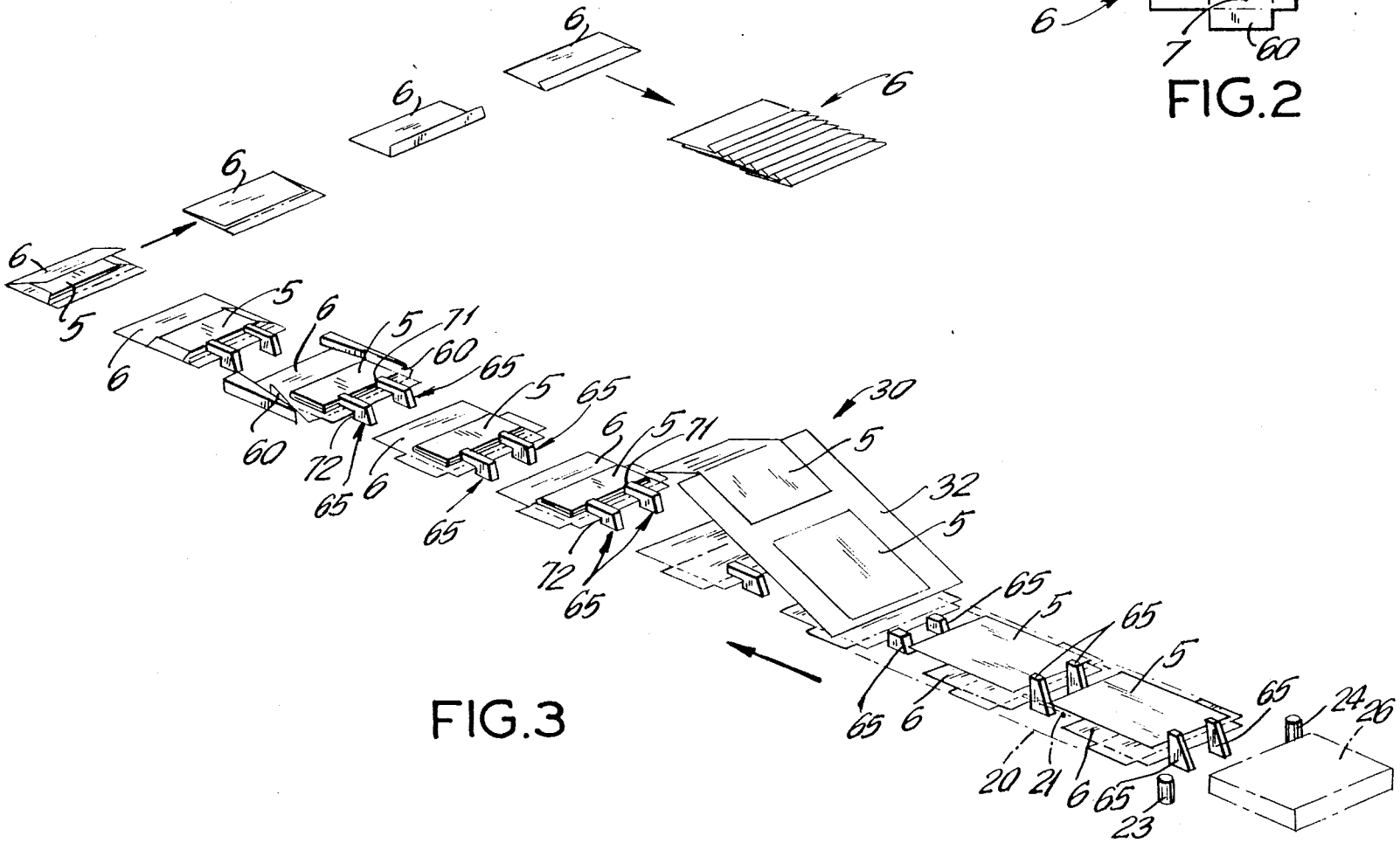
FIG. 3 is a prespective schematic view showing the manner of folding an envelope around a letter.
Figure 4:
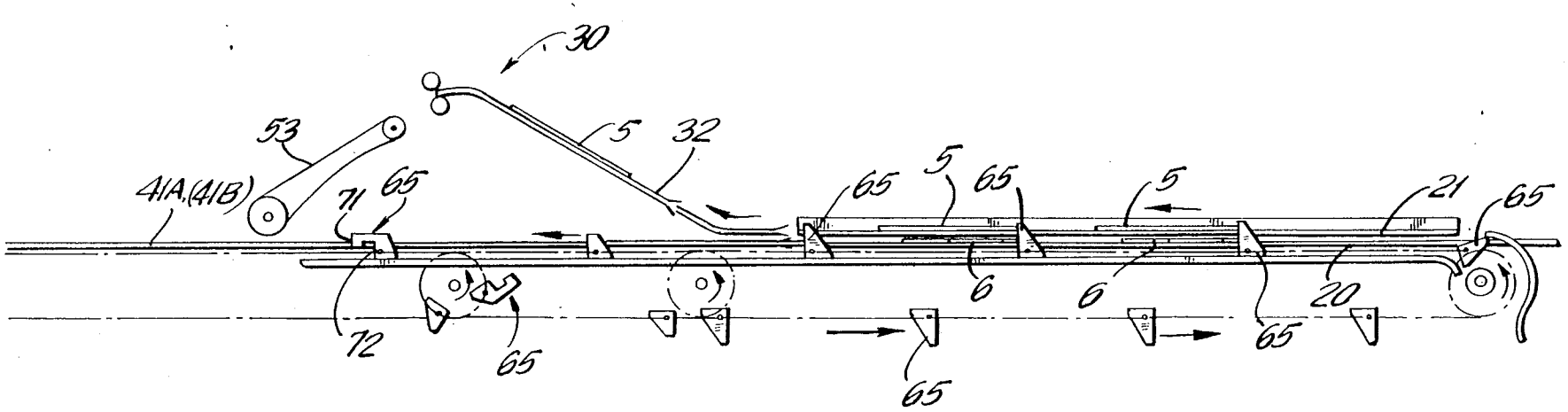
FIG. 4 is a schematic side elevational view showing the conveyor mechanism for moving the envelope and the letter before the letter is folded.
Figure 5:
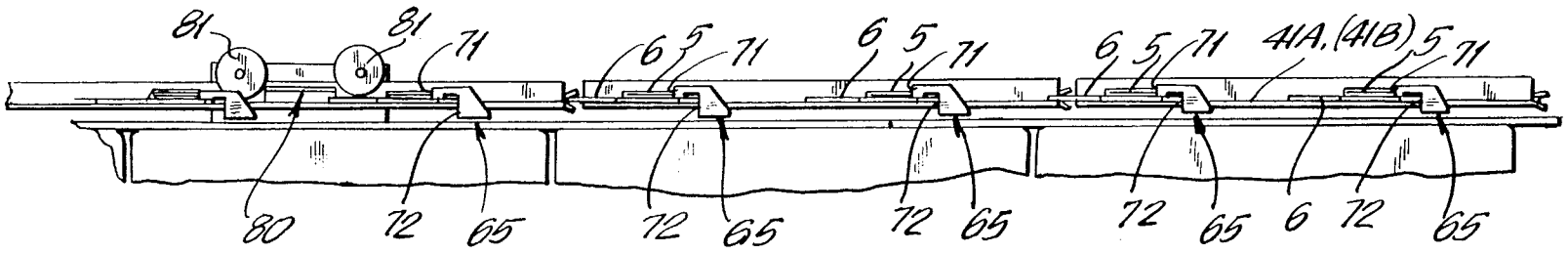
FIG. 5 is a schematic side elevational view showing the mechanism for maintaining the juxtaposition of the letter to the envelope after the letter is folded.

Referring to the drawing, and, more particularly, to FIGS. 1 and 2, a stack of inserts 5 is provided as well as a stack of envelopes 6. Each stack is provided in hoppers (not shown) face down. Each letter or insert assembly 5 may have a message and a personalized address thereon and may also have other codes thereon. Each envelope assembly 6 has a front panel 7 which has a personalized address, which corresponds to the personalized address on the letter assembly 5 it is to be combined with, as well as a return address. Each envelope 6 has a rear panel 8 attached to a front panel 7 by a fold line 10 and flap 9 attached by a fold line 11 to the front panel 7.

The envelope assembly 6 is also provided with end flaps 60 extending from the end edges of the front panel 7. It will be noted that this envelope looks like an ordinary mailing envelope. Ideally, the insert material is first placed on the front panel 7, and the side end flaps 60 are then folded over the end flaps 60 and glued. Lastly, the seal flap 9 is folded the letter. Thereafter, the rear panel 8 is folded over the end flaps 60 and glued. Lastly, the seal flap 9 is folded over the rear panel 8 and adhered thereto so that the finished envelope looks identical to an ordinary business envelope.

The stacks of inserts 5 and envelopes 6 are preferably on either side of a pair of superimposed conveyor means 20-21. The stacks of letters 5 and envelopes 6 are fed from the bottom by any conventional feeding means, such as vacuum means, so that the insert 5 is deposited on the upper conveyor means 21 and the envelope is on the lower conveyor means 20. As has ben explained above, the numbering of the inserts in the stacks are in inverse order so that additional inserts may be placed on top of it. The letters 5 and envelopes 6 have code indicia thereon and the machine is provided with reading means 23 and 24, beneath each stack of letters 5 and envelopes 6, respectively. These reading means are designed to read codes or other indicia on the letters 5 and envelopes 6 to insure that the proper envelope 6 is matched with the proper letter 5. The reading and matching is performed before the inserts and letters are fed from the stacks. The reading devices 23 and 24 may also read other indicia on letters 5 or envelopes 6 which directs the machine to have additional inserts deposited on the envelope.

The pre-cut envelope asemblies 6 and the respective pre-cut letter insert assemblies 5 are fed from the bottom of their stacks. The reading mechanisms 23 and 24 are mounted adjacent to the bottom of the stacks so that the identifying data on the letter insert assemblies and the envelope assemblies are read before they are fed from the stacks to the conveyor. If they do not match, the operator is alerted immediately, and the feeding of the inserts and the letters is stopped for correction of the problem. However, the machine can continue to fold and glue previously-fed and matched letter inserts and envelope assemblies.

The envelope 6 and the letter 5 move along by conveyors 21-20 until they reach the diverting mechanism 30. Preferably, the movement of conveyors 20-21 is staggered so that both feed mechanisms can feed from the bottom of the stacks of letters 5 and envelopes 6 simultaneously.

If desired, additional feed mechanisms may be provided either behind conveyor means 20-21 or downstream thereof to feed additional pre-cut inserts to the conveyor. Furthermore, it is also possible to use a continuous web feed means 28 which will supply other inserts which have not been pre-cut but which are cut before they are fed to the conveyor system 20-21.

Immediately in front of the conveyor means 20-21 is the diverting assembly 30 comprising downward ramp mechanism 31 adapted to deflect the envelope assembly 6 downwardly onto conveyor means 40 and upward ramp means 32 adapted to move the insert assembly 5 upwardly for insertion in a folding assembly (not shown).

The conveyor means 40 comprises a continuously-moving conveyor 41 which may be driven by a wheel and chain assembly (not shown). The conveyor 41 has a plurality of transversely-located upwardly-extending longitudinally-spaced drive pins 44. The drive pins 44 are located on each side of the center line of the conveyor 41. When the envelope assemblies 6 are deposited onto the conveyor 41, the pins 44 strike the rear edge of each envelope assembly 6 to move it along with the conveyor 41. The pins 44 are adapted not only to strike and move the envelope assembly 6, but also to cause the letter assemblies 5 to be deposited onto the envelope assembly 6 and to move the envelope assembly 6 and the letter assembly 5 along together.

The folding mechanism which folds the letter assembly 5 before it is deposited onto the envelope assembly 6 may be any well known mechanism, which will fold the letter assembly 5 in two or more folds, for example, a mechanism similar to the one shown in U.S. Pat. No. 1,879,990. This will fold the letter assembly 5 in two or more folds depending on the particular type of folding desired. The folding mechanism is a standard folding mechanism and, hence, will not be described in greater detail.

After the letter assembly 5 is folded, it is moved to an inclined chute 53 which overlies the conveyor 41, and terminates in a horizontal toe 54. The letter assembly slides down the chute 53 until it rests on the toe 54. Rollers (not shown) may be used to push the letters downwardly on the slide 53, if desired. The toe 54 is positioned in close adjacency over the conveyor 41. The chute 53 has longitudinal slits 55 therein to permit the pins 44 of the conveyor 41 to move therethrough. Guide rails (not shown) may also be provided to prevent the letter assembly 5 from angling when sliding down chute 53.

With the letter assembly 5 resting on toe 54, the pins 44 which are moving the envelope assembly 6 forward, move through the slits 55 and strike the rear edge of the folded letter assembly 5 so as to move it off toe 54 and deposit it on their corresponding personalized envelope assembly 6. Since the letter assembly 5 is moving at about the same speed as the envelope assembly 6, chute 53 allows letters 5 to move down to toe 54 at least as quickly as it takes the envelopes to be positioned below toe 54 so that each personalized letter assembly 5 will be deposited on its respective personalized envelope assembly 6.

The envelope assembly 6 with letter assembly 5 thereon may then be moved by pins 44 beneath an additional insert depositing assembly (not shown) where additional inserts may be deposited, if desired.

The combination may then be moved by pins 44 beneath an adhesive applicator (not shown) which applies adhesive to the envelope assembly 6. The adhesive applicator may be any conventional type of applicator, such as a sprayer, a roller, or a spotter. However, a pre-gummed envelope may also be used, if desired. The combination is then moved to an envelope wrapping assembly (not shown) which folds the envelope.

The folded and edge sealed envelope assembly 6 is then moved onto a second conveyor (not shown) which is at an angle (preferably at a right angle) to the first conveyor 41. The second conveyor moves the envelope past a flap folding mechanism (not shown) which folds the flap 9 as each envelope moves past it. An adhesive is applied to flap 9 by a suitable applicator as the envelope assembly 6 moves past it. The envelope assembly 6 is then moved past a suitable pressure roller which seals flap 9 and is then moved off the conveyor.

Initially, the envelope assemblies 6 and the letter insert assemblies 5 are pushed by the pushers 65 mounted on a two-tiered conveyor 20-21. The conveyor 20-21 maintains each letter insert assembly 5 spaced above the envelope assembly 6 as the two are moved together. The pushers 65 strike the rear edges of both the envelope assembly 6 and the letter insert assembly 5 and move them together with the rear edges in substantially vertical alignment with each other. After letter 5 is fed to the folder 30, and after it is folded, it is deposited by ramp 53 on another double-tiered conveyor 41A-41B. The letter insert assembly is deposited over the front panel 7 of the envelope assembly 6. the pushers 65 of the second conveyor mechanism 41A-41B are L-shaped with the upper surface 71 being in advance of the lower surface 72. The upper surface 71 of the pusher 65 pushes the upper letter insert assembly, and the lower surface 72 of the pusher 65 pushes the lower envelope assembly 6. Hence, the rear edge of the letter is always maintained in advance of the rear edge of the envelope 6 so that it always lies on the front panel 7 of the envelope assembly 6. Thus, when the envelope assembly 6 is folded around the letter insert assembly 5, the letter insert assembly 5 remains interposed between the front and rear panels 7 and 8.

Figure 6:
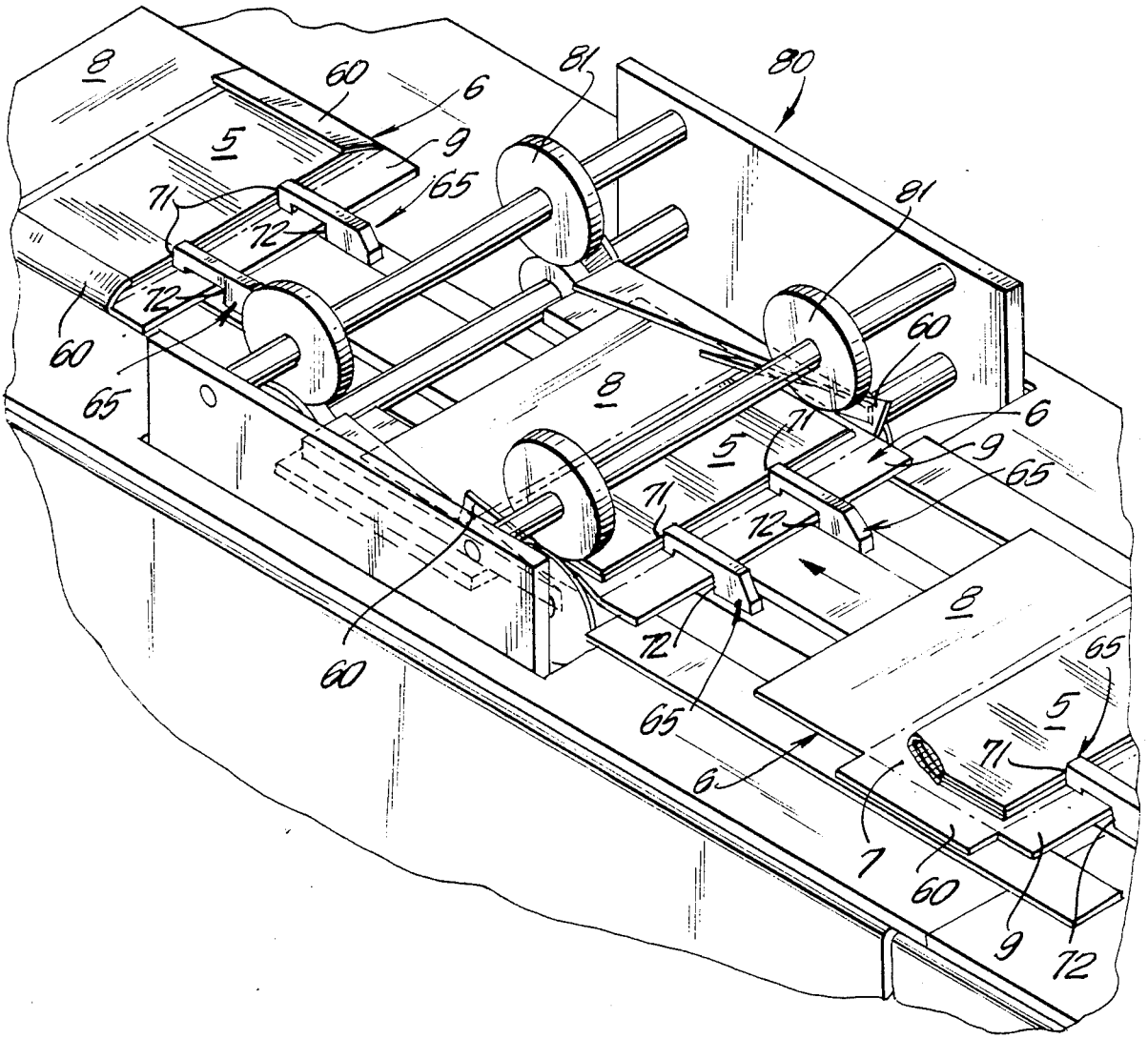
FIG. 6 is a perspective detail showing the moving mechanism as well as the end flap folding mechanism.

The first folding mechanism comprises a side folder assembly 80 which has rollers 81 which fold end flaps 60 over the letter insert assembly 5, as shown in FIG. 6.

Thereafter, the rear panel 8 is folded over the letter and adhered to the end flaps 60. Lastly, the seal flap 9 is folded over and adhered to the rear panel 8, so that the letter 5 is interposed between front and rear panels 7 and 8 of the envelope.

The various components which are shown and described herein have been illustrated schematically for ease in description. The actual components used are well-known mechanisms and may be the ones which are described and shown in U.S. Pat. Nos. 4,299,073; 4,343,129; and 4,071,997, although it will be understood that other components may be used in connection with the invention, if desired.

It will thus be seen that the present invention provides an improved mechanism which will automatically feed individual pre-cut sheets and stuff a personalized letter or some other pre-cut insert into a personalized envelope, which will permit additional inserts to be automatically added to the envelope, which will automatically seal the contents within the envelopes and which will combine pre-cut inserts and envelopes fed from different sources and form them into a completed mailing envelope.

Although the application has been described with respect to a personalized envelope assembly and a personalized insert assembly, it will be understood that the invention is equally applicable to unpersonalized insert assemblies as will as unpersonalized envelope assemblies. Likewise, the application may be used with a personalized envelope assembly and an unpersonalized insert assembly, as well as a personalized insert assembly and an unpersonalized envelope assembly. In fact, the invention is even applicable to the use of a window envelope assembly where the address of the insert assembly would show through. In addition, the invention is adapted to be used with a multi-sheet personalized insert assembly which would be fed into either a personalized or unpersonalized envelope assembly.

As stated above, the reading units determine the number of inserts to be used with a particular envelope assembly. For convenience, the data on the insert assemblies and the letter assemblies which is readable by the reading means, would preferably be located on an edge of the two assemblies which would thereafter be cut off or otherwise removed before the two assemblies are assemblied together.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mechanism for forming an envelope comprising a stack of pre-cut single predetermined individual envelope assemblies having a rear edge and a stack of pre-cut single predetermined individual letter insert assemblies having a rear edge, first means for moving each individual envelope assembly along a first path, second means for moving each individual letter insert assembly along a second path, said first and second moving means comprising a two-tiered conveyor mechanism with each tier superimposed over and in spaced relationship to each other, each tier of said conveyor mechanism being adapted to receive an assembly, means operatively associated with said first and second means to move both assemblies with their rear edges in vertical alignment with each other, each of said assemblies being individually fed to their respective conveyor mechanism tiers from stacks of assemblies 1 code data on said letter insert assembly and said envelope assembly, reading means adjacent the stacks for sensing said code data to determine whether an insert assembly matches an envelope assembly before said assemblies are fed to their respective conveyor mechanism tiers and before the assemblies are fed from the stacks, means for comparing the code data sensed by the reading means to determine whether a predetermined letter insert assembly is matched with a predetermined envelope assembly whereby feeding from said stacks is interrupted if the code data on the predetermined letter insert assembly does not match with a predetermined envelope assembly, third and fourth means in line with said first and second moving means for receiving said assemblies from said first and second moving means and for causing said assemblies to move along superimposed third and fourth paths, said third and fourth means comprising a two-tiered conveyor mechanism, said third means includes means for folding each letter insert assembly and for positioning each predetermined letter insert assembly in superimposed relationship to each predetermined envelope assembly, said fourth means includes means for causing said folded letter insert assembly to be deposited on top of said moving envelope assembly, means for folding the envelope assembly around said letter insert assembly, means for sealing the edges of said envelope assembly, said envelope assembly comprising a front panel, a rear panel, end flaps and a seal flap, said means for depositing deposits the folded letter insert assembly onto said front panel, and means operatively associated with said two-tiered conveyor mechanism for maintaining said folded letter insert assembly on said front panel during movement of both said assemblies.

2. A mechanism as claimed in claim 1 wherein said maintaining means comprises pushers for different pushing areas in advance of each other.

3. A mechanism as claimed in claim 2 wherein said pushers are L-shaped and having pushing surfaces in advance of each other.

4. A mechanism as claimed in claim 3 wherein one of said pushing surfaces pushes the envelope and the other of said pushing surfaces pushes the folded letter and maintains the folded letter on the front panel of the envelope.

5. A mechanism as claimed in claim 4 wherein means are provided for folding said end flaps over the envelope assembly.

6. A mechanism as claimed in claim 5 wherein means are provided for folding the rear panel over the folded end flaps and adhering it to the end flaps.

* * * * *